US008249860B2

(12) United States Patent
Sato et al.

(10) Patent No.: US 8,249,860 B2
(45) Date of Patent: Aug. 21, 2012

(54) ADAPTIVE SOUND SOURCE VECTOR QUANTIZATION UNIT AND ADAPTIVE SOUND SOURCE VECTOR QUANTIZATION METHOD

(75) Inventors: Kaoru Sato, Kanagawa (JP); Toshiyuki Morii, Kanagawa (JP)

(73) Assignee: Panasonic Corporation, Osaka (JP)

( * ) Notice: Subject to any disclaimer, the term of this patent is extended or adjusted under 35 U.S.C. 154(b) by 509 days.

(21) Appl. No.: 12/518,943

(22) PCT Filed: Dec. 14, 2007

(86) PCT No.: PCT/JP2007/074137

§ 371 (c)(1),
(2), (4) Date: Jun. 12, 2009

(87) PCT Pub. No.: WO2008/072736

PCT Pub. Date: Jun. 19, 2008

(65) Prior Publication Data

US 2010/0106492 A1 Apr. 29, 2010

(30) Foreign Application Priority Data

Dec. 15, 2006 (JP) ..... 2006-338343
May 23, 2007 (JP) ..... 2007-137031

(51) Int. Cl.
*G10L 19/00* (2006.01)

(52) U.S. Cl. ..... 704/201; 704/200; 704/200.1; 704/500; 704/501

(58) Field of Classification Search ..... 704/200–201, 704/500–502

See application file for complete search history.

(56) References Cited

U.S. PATENT DOCUMENTS 5,651,090 A * 7/1997 Moriya et al. ..... 704/200.1
6,330,531 B1 * 12/2001 Su ..... 704/204
6,397,176 B1 * 5/2002 Su ..... 704/220
6,947,889 B2 9/2005 Yasunaga et al.
(Continued)

FOREIGN PATENT DOCUMENTS

EP 0607989 7/1994
(Continued)

OTHER PUBLICATIONS

European Search Report in EP 07850641.7 on Sep. 9, 2011.
(Continued)

*Primary Examiner* — Douglas Godbold
(74) *Attorney, Agent, or Firm* — Greenblum & Bernstein, P.L.C.

(57) ABSTRACT

Disclosed is an adaptive sound source vector quantization device capable of reducing deviation of the quantization accuracy of the adaptive sound source vector quantization of each sub-frame when performing an adaptive sound source vector quantization in a sub-frame unit by using a greater information amount in a first sub-frame than in a second sub-frame. In this device: when the device performs the adaptive sound source vector quantization of the first sub-frame, an adaptive sound source vector generation unit (104) cuts out an adaptive sound source vector of length r (r, n, m are integers satisfying the relationship: m < r=n: n is a frame length, m is a sub-frame length) from an adaptive sound source codebook (103); a synthesis filter (105) generates an impulse response matrix of r r by using a linear prediction coefficient of the first sub-frame inputted; a search target vector generation unit (106) generates a search target vector by using a target vector of the sub-frame unit; and an evaluation scale calculation unit (107) calculates the evaluation scale of the adaptive sound source vector quantization.

11 Claims, 6 Drawing Sheets

U.S. PATENT DOCUMENTS

| | | | | |
|---|---|---|---|---|
| 6,988,065 | B1 | 1/2006 | Yasunaga et al. | |
| 7,383,176 | B2 | 6/2008 | Yasunaga et al. | |
| 2005/0058208 | A1 | 3/2005 | Ehara | |
| 2005/0197833 | A1* | 9/2005 | Yasunaga et al. | 704/223 |
| 2007/0156395 | A1* | 7/2007 | Ojala | 704/211 |
| 2010/0082337 | A1 | 4/2010 | Sato et al. | |

FOREIGN PATENT DOCUMENTS

| | | | |
|---|---|---|---|
| EP | 1093116 | | 4/2001 |
| EP | 2101319 | | 9/2009 |
| JP | 8-248995 | A | 9/1996 |
| JP | 10-242867 | A | 9/1998 |
| JP | 2000-298500 | A | 10/2000 |
| JP | 2005-091749 | A | 4/2005 |
| WO | 95/16260 | | 6/1995 |

OTHER PUBLICATIONS

English language Abstract of JP 8-248995 A, Sep. 27, 1996.
English language Abstract of JP 10-242867 A, Sep. 11, 1998.
English language Abstract of JP 2005-091749 A, Apr. 7, 2005.
English language Abstract of JP 2000-298500 A, Oct. 24, 2000.
Schroeder et al., "Code-Excited Linear Prediction (CELP): High-Quality Speech at Very Low Rates," IEEE Proceedings, ICASSP 1985,pp. 937-940.
ITU-T Recommendation G.729, "General Aspects of Dogital Transmission Systems: Coding of Speech at 8 kbit/s using Conjugate-Structure Algebraic-Code-Excited Linear Prediction (CS-ACELP)," Mar. 1996, pp. 17-19.
U.S. Appl. No. 12/518,944 to Sato et al, which was filed Jun. 12, 2009.

* cited by examiner

ADAPTIVE SOUND SOURCE VECTOR QUANTIZATION UNIT AND ADAPTIVE SOUND SOURCE VECTOR QUANTIZATION METHOD

TECHNICAL FIELD

The present invention relates to an adaptive excitation vector quantization apparatus and adaptive excitation vector quantization method for vector quantization of adaptive excitations in CELP (Code Excited Linear Prediction) speech encoding. In particular, the present invention relates to an adaptive excitation vector quantization apparatus and adaptive excitation vector quantization method used in a speech encoding apparatus that transmits speech signals, in fields such as a packet communication system represented by Internet communication and a mobile communication system.

BACKGROUND ART

In the field of digital radio communication, packet communication represented by Internet communication, speech storage and so on, speech signal encoding and decoding techniques are essential for effective use of channel capacity and storage media for radio waves. In particular, a CELP speech encoding and decoding technique is a mainstream technique (for example, see non-patent document 1).

A CELP speech encoding apparatus encodes input speech based on speech models stored in advance. To be more specific, the CELP speech encoding apparatus divides a digital speech signal into frames of regular time intervals, for example, frames of approximately 10 to 20 ms, performs a linear prediction analysis of a speech signal on a per frame basis to find the linear prediction coefficients ("LPC's") and linear prediction residual vector, and encodes the linear prediction coefficients and linear prediction residual vector individually. A CELP speech encoding or decoding apparatus encodes or decodes a linear prediction residual vector using an adaptive excitation codebook storing excitation signals generated in the past and a fixed codebook storing a specific number of fixed-shape vectors (i.e. fixed code vectors). Here, while the adaptive excitation codebook is used to represent the periodic components of a linear prediction residual vector, the fixed codebook is used to represent the non-periodic components of the linear prediction residual vector that cannot be represented by the adaptive excitation codebook.

Further, encoding or decoding processing of a linear prediction residual vector is generally performed in units of subframes dividing a frame into shorter time units (approximately 5 ms to 10 ms). In ITU-T Recommendation G.729 disclosed in Non-Patent Document 2, an adaptive excitation is vector-quantized by dividing a frame into two subframes and by searching for the pitch periods of these subframes using an adaptive excitation codebook. Such a method of adaptive excitation vector quantization in subframe units makes it possible to reduce the amount of calculations compared to the method of adaptive excitation vector quantization in frame units.

Non-Patent Document 1: M. R. Schroeder, B. S. Atal "IEEE proc. ICASSP" 1985, "Code Excited Linear Prediction: High Quality Speech at Low Bit Rate], pages 937-940

Non-Patent Document 2: "ITU-T Recommendation G.729," ITU-T, 1996/3, pages 17-19

DISCLOSURE OF INVENTION

Problem to be Solved by the Invention

However, when the amount of information involved in pitch period search processing is different between subframes in an apparatus that performs the above-noted adaptive excitation vector quantization in subframe units, for example, when the amount of information involved in adaptive excitation vector quantization in the first subframe is 8 bits and the amount of information involved in adaptive excitation vector quantization in the second subframe is 4 bits, there is an imbalance in the accuracy of adaptive excitation vector quantization between these two subframes, that is, the accuracy of adaptive excitation vector quantization in the second subframe degrades compared to the accuracy of adaptive excitation vector quantization in the first subframe. Here, there is a problem that no processing is carried out to alleviate the imbalance in the accuracy of adaptive excitation vector quantization.

It is therefore an object of the present invention to provide an adaptive excitation vector quantization apparatus and adaptive excitation vector quantization method that alleviate the imbalance in the accuracy of speech encoding between subframes and improve the overall accuracy of speech encoding, upon performing adaptive excitation vector quantization per subframe using different amounts of information in CELP speech encoding for performing linear prediction encoding in subframe units.

Means for Solving the Problem

The adaptive excitation vector quantization apparatus of the present invention that receives as input linear prediction residual vectors of a length m and linear prediction coefficients generated by dividing a frame of a length n into a plurality of subframes of the length m and performing a linear prediction analysis (where n and m are integers), and that performs adaptive excitation vector quantization per subframe using more bits in a first subframe than in a second subframe, employs a configuration having: an adaptive excitation vector generating section that cuts out an adaptive excitation vector of a length r ($m<r\leqq n$) from an adaptive excitation codebook; a target vector forming section that generates a target vector of the length r from the linear prediction residual vectors of the plurality of subframes; a synthesis filter that generates a $r\times r$ impulse response matrix using the linear prediction coefficients of the plurality of subframes; an evaluation measure calculating section that calculates evaluation measures of adaptive excitation vector quantization with respect to a plurality of pitch period candidates, using the adaptive excitation vector of the length r, the target vector of the length r and the $r\times r$ impulse response matrix; and an evaluation measure comparison section that compares the evaluation measures with respect to the plurality of pitch period candidates and finds a pitch period of a highest evaluation measure as a result of the adaptive excitation vector quantization of the first subframe.

The adaptive excitation vector quantization method of the present invention that receives as input linear prediction residual vectors of a length m and linear prediction coefficients generated by dividing a frame of a length n into a plurality of subframes of the length m and performing a linear prediction analysis (where n and m are integers), and that performs adaptive excitation vector quantization per subframe using more bits in a first subframe than in a second subframe, employs a configuration having the steps of: cutting out an adaptive excitation vector of a length r ($m<r\leqq n$) from an adaptive excitation codebook; generating a target vector of the length r from the linear prediction residual vectors of the plurality of subframes; generating a $r\times r$ impulse response matrix using the linear prediction coefficients of the plurality of subframes; calculating evaluation measures of adaptive excitation vector quantization with respect to a plurality of pitch period candidates, using the adaptive excitation vector of the length r, the target vector of the length r and the r×r impulse response matrix; and comparing the evaluation measures with respect to the plurality of pitch period candidates and finding the pitch period of a highest evaluation measure as a result of the adaptive excitation vector quantization of the first subframe.

Advantageous Effect of the Invention

According to the present invention, in CELP speech encoding for performing linear prediction encoding in subframe units, when adaptive excitation vector quantization is performed in subframe units using the greater amount of information in the first subframe than in the second subframe, the adaptive excitation vector quantization in the first subframe is performed by forming an impulse response matrix of longer rows and columns than the subframe length with linear prediction coefficients per subframe and by cutting out a longer adaptive excitation vector than the subframe length from the adaptive excitation codebook. By this means, it is possible to alleviate the imbalance in the accuracy of adaptive excitation vector quantization between subframes, and improve the overall accuracy of speech encoding.

BEST MODE FOR CARRYING OUT THE INVENTION

An example case will be described with embodiments of the present invention, where a CELP speech encoding apparatus including an adaptive excitation vector quantization apparatus divides each frame forming a speech signal of 16 kHz into two subframes, performs a linear prediction analysis of each subframe, and calculates linear prediction coefficients and linear prediction residual vectors in subframe units.

Further, in the following explanation, the frame length and the subframe length will be referred to as "n" and "m," respectively.

Embodiments of the present invention will be explained below in detail with reference to the accompanying drawings.

(Embodiment 1)

Figure 1:
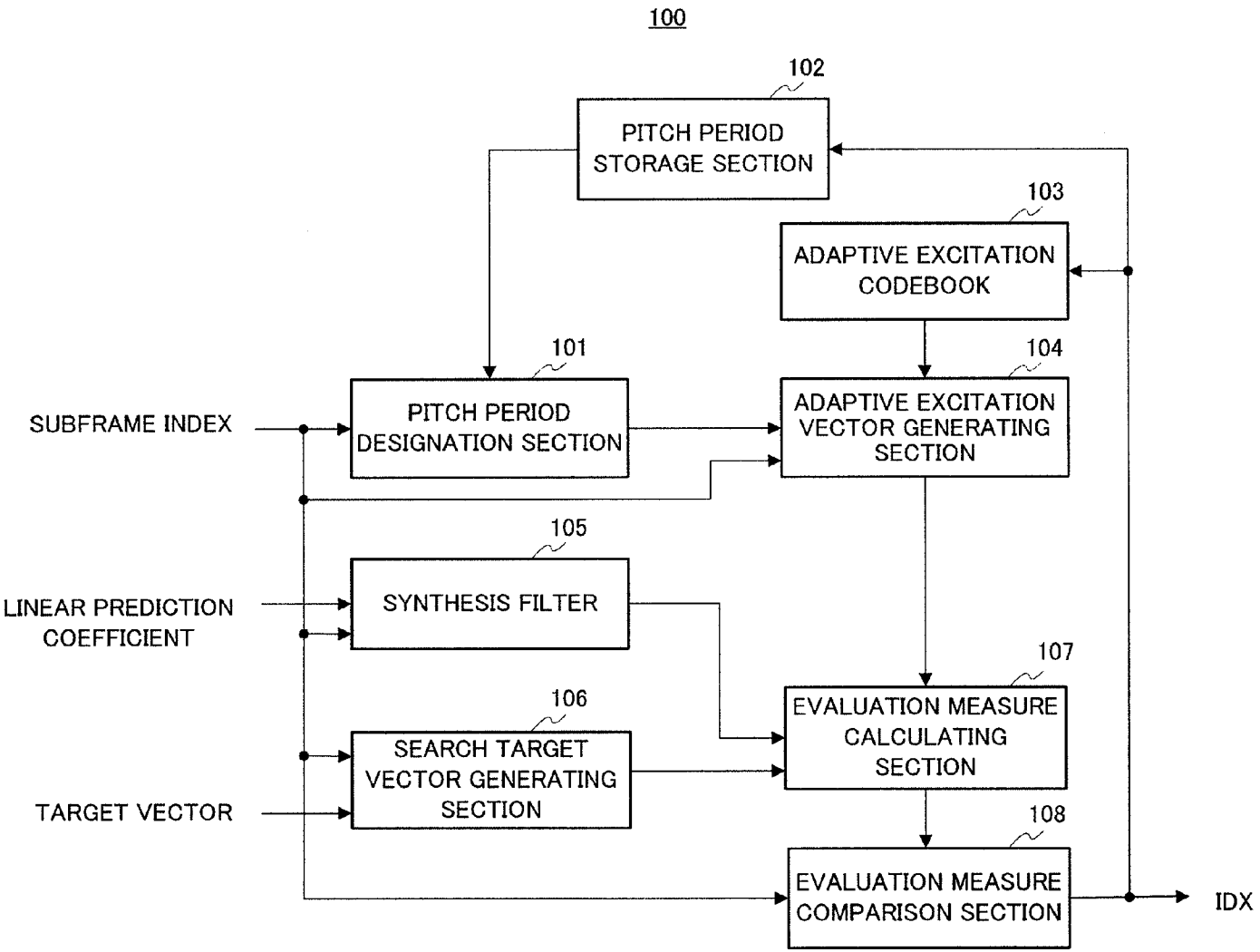
FIG. 1 is a block diagram showing main components of an adaptive excitation vector quantization apparatus according to Embodiment 1 of the present invention.

FIG. 1 is a block diagram showing main components of adaptive excitation vector quantization apparatus 100 according to Embodiment 1 of the present invention.

In FIG. 1, adaptive excitation vector quantization apparatus 100 is provided with pitch period designation section 101, pitch period storage section 102, adaptive excitation codebook 103, adaptive excitation vector generating section 104, synthesis filter 105, search target vector generating section 106, evaluation measure calculating section 107 and evaluation measure comparison section 108. Further, for each subframe, adaptive excitation vector quantization apparatus 100 receives as input a subframe index, linear prediction coefficient and target vector.

Here, the subframe index indicates the order of each subframe, which is acquired in the CELP speech encoding apparatus including adaptive excitation vector quantization apparatus 100 according to the present embodiment, in its frame. Further, the linear prediction coefficient and target vector refer to the linear prediction coefficient and linear prediction residual (excitation signal) vector of each subframe acquired by performing a linear prediction analysis of each subframe in the CELP speech encoding apparatus.

For the linear prediction coefficients, LPC parameters or LSF (Line Spectral Frequency) parameters, which are frequency domain parameters and which are interchangeable with the LPC parameters in one-to-one correspondence, and LSP (Line Spectral Pairs) parameters are used.

Pitch period designation section 101 sequentially designates pitch periods in a predetermined range of pitch period search, to adaptive excitation vector generating section 104, based on subframe indices that are received as input on a per subframe basis and the pitch period in the first subframe stored in pitch period storage section 102.

Pitch period storage section 102 has a built-in buffer storing the pitch period in the first subframe, and updates the built-in buffer based on the pitch period index IDX fed back from evaluation measure comparison section 108 every time a pitch period search is finished on a per subframe basis.

Adaptive excitation codebook 103 has a built-in buffer storing excitations, and updates the excitations based on the pitch period index IDX fed back from evaluation measure comparison section 108 every time a pitch period search is finished on a per subframe basis.

Adaptive excitation vector generating section 104 cuts out an adaptive excitation vector having a pitch period designated from pitch period designation section 101, by a length according to the subframe index that is received as input on a per subframe basis, and outputs the result to evaluation measure calculating section 107.

Synthesis filter 105 forms a synthesis filter using the linear prediction coefficient that is received as input on a per subframe basis, and outputs an impulse response matrix of the length according to the subframe indices that are received as input on a per subframe basis, and outputs the result to evaluation measure calculating section 107.

Search target vector generating section 106 adds the target vectors that are received as input on a per subframe basis, cuts out, from the resulting target vector, a search target vector of a length according to the subframe indices that are received as input on a per subframe basis, and outputs the result to evaluation measure calculating section 107.

Using the adaptive excitation vector received as input from adaptive excitation vector generating section 104, the impulse response matrix received as input from synthesis filter 105 and the search target vector received as input from search target vector generating section 106, evaluation measure calculating section 107 calculates the evaluation measure for pitch period search, that is, the evaluation measure for adaptive excitation vector quantization and outputs it to evaluation measure comparison section 108.

Based on the subframe indices that are received as input on a per subframe basis, evaluation measure comparison section 108 finds the pitch period where the evaluation measure received as input from evaluation measure calculating section 107 is the maximum, outputs an index IDX indicating the found pitch period to the outside, and feeds back the index IDX to pitch period storage section 102 and adaptive excitation codebook 103.

The sections of adaptive excitation vector quantization apparatus 100 will perform the following operations.

If a subframe index that is received as input on a per subframe basis indicates the first subframe, pitch period designation section 101 sequentially designates the pitch period T_int, for example, pitch period designation section 101 sequentially designates 256 patterns of pitch period T_int from "32" to "287" corresponding to 8 bits (T_int=32, 33, . . . , 287) in a predetermined pitch period search range, to adaptive excitation vector generating section 104. Here, "32" to "287" indicates the indices indicating pitch periods.

Further, if a subframe index that is received as input on a per subframe basis indicates the second subframe, using the pitch period T_INT' stored in pitch period storage section 102, pitch period designation section 101 sequentially designates 16 patterns of pitch period T_int=T_INT'−7, T_INT'−6, . . . , T_INT'+8, corresponding to 4 bits, to adaptive excitation vector generating section 104. That is, using the method called "delta lag," the difference between the pitch period in the second subframe and the pitch period in the first subframe is calculated.

Pitch period storage section 102 is formed with a buffer storing the pitch period in the first subframe and updates the built-in buffer using the pitch period T_INT' associated with the pitch period index IDX fed back from evaluation measure comparison section 108 every time a pitch period search is finished on a per subframe basis.

Adaptive excitation codebook 103 has a built-in buffer storing excitations and updates the excitations using the adaptive excitation vector having the pitch period indicated by the index IDX fed back from evaluation measurement comparison section 108, every time a pitch period search is finished on a per subframe basis.

If a subframe index that is received as input on a per subframe basis indicates the first subframe, adaptive excitation vector generating section 104 cuts out, from adaptive excitation codebook 103, the pitch period search analysis length r ($m<r\leqq n$) of an adaptive excitation vector having a pitch period T_int designated by pitch period designation section 101, and outputs the result to evaluation measure calculating section 107 as an adaptive excitation vector P(T_int). Here, r is a value set in advance, and the adaptive excitation vector P(T_int) of a frame length n generated in adaptive excitation vector generating section 104 is represented by following equation 1, if, for example, adaptive excitation codebook 103 is comprised of e vectors represented by exc(0), exc(1), . . . , exc(e−1).

(Equation 1)

$$P(\mathrm{T_int}) = P\begin{bmatrix} exc(e-\mathrm{T_int}) \\ exc(e-\mathrm{T_int}+1) \\ \vdots \\ exc(e-\mathrm{T_int}+m-1) \\ exc(e-\mathrm{T_int}+m) \\ \vdots \\ exc(e-\mathrm{T_int}+r-1) \end{bmatrix} \quad [1]$$

Further, if a subframe index that is received as input on a per subframe basis indicates the second subframe, adaptive excitation vector generating section 104 cuts out, from adaptive excitation codebook 103, the subframe length m of an adaptive excitation vector having pitch period T_int designated from pitch period designation section 101, and outputs the result to evaluation measure calculating section 107 as an adaptive excitation vector P(T_int). For example, if adaptive excitation codebook 103 is comprised of e vectors represented by exc(0), exc(1), . . . , exc(e−1), the adaptive excitation vector P(T_int) of the subframe length m generated in adaptive excitation vector generating section 104, is represented by following equation 2.

(Equation 2)

$$P(\mathrm{T_int}) = P\begin{bmatrix} exc(e-\mathrm{T_int}) \\ exc(e-\mathrm{T_int}+1) \\ \vdots \\ exc(e-\mathrm{T_int}+m-1) \end{bmatrix} \quad [2]$$

Figure 2:
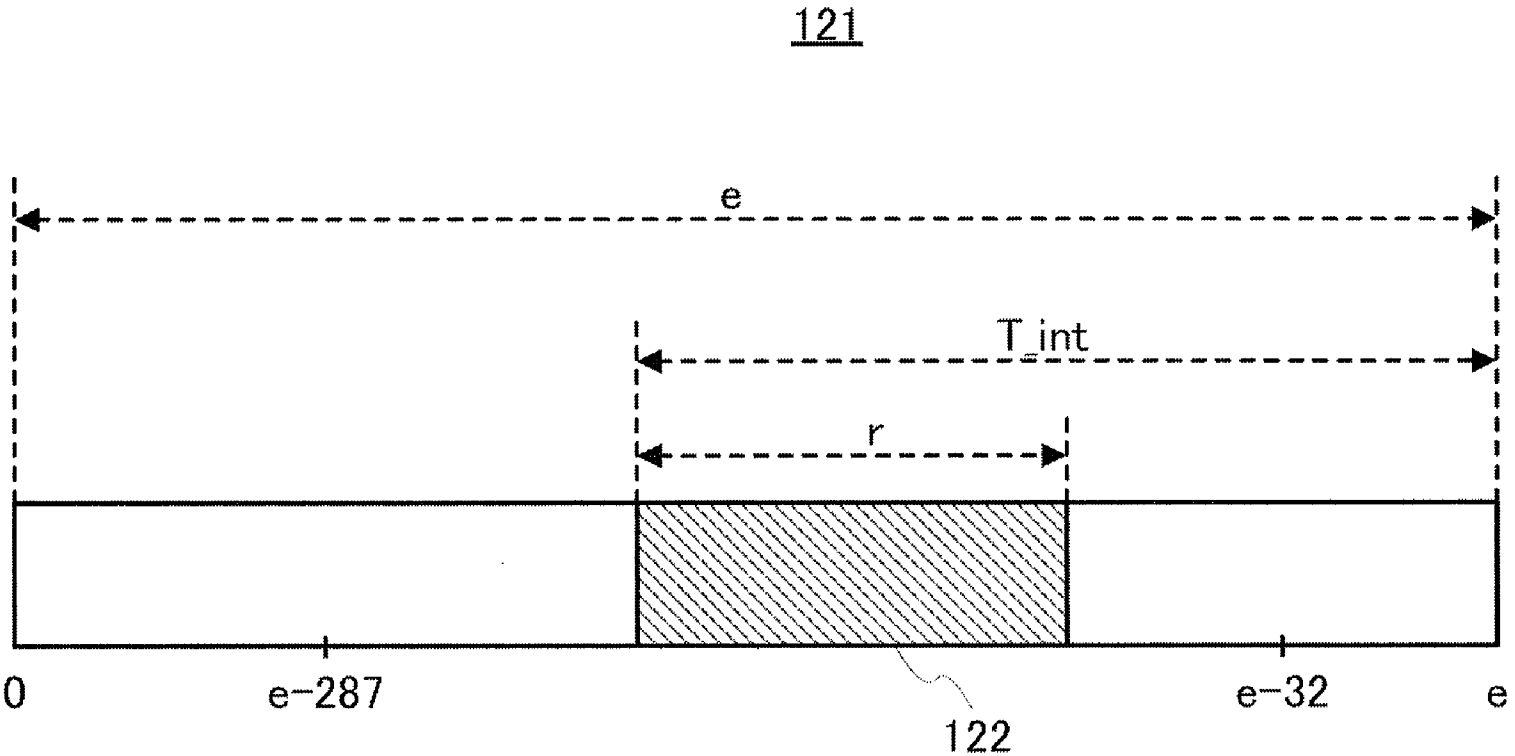
FIG. 2 illustrates an excitation provided in an adaptive excitation codebook according to Embodiment 1 of the present invention.

FIG. 2 illustrates an excitation provided in adaptive excitation codebook 103.

Further, FIG. 2 illustrates the operations of generating an adaptive excitation vector in adaptive excitation vector generating section 104, and illustrates an example case where the length of a generated adaptive excitation vector is the pitch period search analysis length r. In FIG. 2, e represents the length of excitation 121, r represents the length of the adaptive excitation vector P(T_int), and T_int represents the pitch period designated by pitch period designation section 101. As shown in FIG. 2, using the point that is T_int apart from the tail end (i.e. position e) of excitation 121 (i.e. adaptive excitation codebook 103) as the start point, adaptive excitation vector generating section 104 cuts out part 122 of a length r in the direction of the tail end e from the start point, and generates an adaptive excitation vector P(T_int). Here, if the value of T_int is lower than r, adaptive excitation vector generating section 104 may duplicate the cut-out period until its length reaches the length r. Further, adaptive excitation vector generating section 104 repeats the cutting processing shown in above equation 1, for 256 patterns of T_int from "32" to "287."

Synthesis filter 105 forms a synthesis filter using the linear prediction coefficients that are received as input on a per subframe basis, and, if a subframe index that is received as input on a per subframe basis indicates the first subframe, synthesis filter 105 outputs a r×r impulse response matrix H represented by following equation 3, to evaluation measure calculating section 107. On the other hand, if a subframe index that is received as input on a per subframe basis indicates the second subframe, synthesis filter 105 outputs a m×m impulse response matrix H represented by following equation 4, to evaluation measure calculating section 107.

(Equation 3)

$$H = \begin{bmatrix} h(0) & 0 & \dots & 0 \\ h(1) & h(0) & \dots & 0 \\ \vdots & \vdots & \ddots & \vdots \\ h(r-1) & h(n-2) & \dots & h(0) \end{bmatrix} \quad [3]$$

(Equation 4)

$$H = \begin{bmatrix} \mathrm{h_a}(0) & 0 & \dots & 0 \\ \mathrm{h_a}(1) & \mathrm{h_a}(0) & \dots & 0 \\ \vdots & \vdots & \ddots & \vdots \\ \mathrm{h_a}(m-1) & \mathrm{h_a}(m-2) & \dots & \mathrm{h_a}(0) \end{bmatrix} \quad [4]$$

As shown in equations 3 and 4, the impulse response matrix H of a length r is calculated when a subframe index indicates the first subframe, and the impulse response matrix H of a length m is calculated when a subframe index indicates the second subframe.

Search target vector generating section 106 generates a target vector XF of the frame length n, represented by following equation 5, by adding X1=[x(0) x(2) . . . x(m−1)], which is received as input when a subframe index indicates the first subframe, and X2=[x(m) x(m+1) . . . x(n−1)], which is received as input when a subframe index indicates the second subframe.

Further, search target vector generating section 106 generates a search target vector X of a length r, represented by following equation 6, from the target vector XF of the frame length n in the pitch period search processing of the first subframe, and outputs the result to evaluation measure calculating section 107. Further, search target vector generating section 106 generates a search target vector X of a length m, represented by following equation 7, from the target vector XF of the frame length n in pitch period search processing of the second subframe, and outputs the result to evaluation measure calculating section 107.

[5]

$$XF=[x(0)x(1)\ldots x(m-1)x(m)\ldots x(n-1)] \quad \text{(Equation 5)}$$

[6]

$$X=[x(0)x(1)\ldots x(m-1)x(m)\ldots x(r-1)] \quad \text{(Equation 6)}$$

[7]

$$X=[x(m)\ldots x(n-1)] \quad \text{(Equation 7)}$$

In the pitch period search processing of the first subframe, evaluation measure calculating section 107 calculates the evaluation measure Dist(T_int) for pitch period search (i.e. adaptive excitation vector quantization) according to following equation 8, using an adaptive excitation vector P(T_int) of a length r received as input from adaptive excitation vector generating section 104, the r×r impulse response matrix H received as input from synthesis filter 105 and the search target vector X of a length r received as input from search target vector generating section 106, and outputs the result to evaluation measure comparison section 108. Further, in the pitch period search processing of the second subframe, evaluation measure calculating section 107 calculates an evaluation measure Dist(T_int) for pitch period search (i.e. adaptive excitation vector quantization) according to following equation 8, using the adaptive excitation vector P(T_int) of the subframe length m received as input from adaptive excitation vector generating section 104, the m×m impulse response matrix H received as input from synthesis filter 105 and the search target vector X of the subframe length m received as input from search target vector generating section 106, and outputs the result to evaluation measure comparison section 108.

(Equation 8)

$$Dist(\text{T_int}) = \frac{(XHP(\text{T_int}))^2}{|HP(\text{T_int})|^2} \quad [8]$$

As shown in equation 8, evaluation measure calculating section 107 calculates, as an evaluation measure, the square error between the search target vector X and a reproduced vector acquired by convoluting the impulse response matrix H and the adaptive excitation vector P(T_int). Further, upon calculating the evaluation measure Dist(T_int) in evaluation measure calculating section 107, instead of the search impulse response matrix H in equation 8, a matrix H' is generally used which is acquired by multiplying a search impulse response matrix H and an impulse response matrix W (i.e. H×W) in a perceptual weighting filter included in a CELP speech encoding apparatus. However, in the following explanation, H and H' are not distinguished and both will be referred to as "H."

In the pitch period search processing of the first subframe, evaluation measure comparison section 108 performs comparison between, for example, 256 patterns of an evaluation measure Dist(T_int) received as input from evaluation measure calculating section 107, finds the pitch period T_int' associated with the maximum evaluation measure Dist (T_int), and outputs a pitch period index IDX indicating the pitch period T_int', to the outside, pitch period storage section 102 and adaptive excitation codebook 103. Further, in the pitch period search processing of the second subframe, evaluation measure comparison section 108 performs comparison between, for example, 16 patterns of an evaluation measure Dist(T_int) received as input from evaluation measure calculating section 107, finds the pitch period T_int' associated with the maximum evaluation measure Dist (T_int), and outputs a pitch period index IDX indicating the pitch period difference between the pitch period T_int' and the pitch period T_int' calculated in the pitch period search processing of the first subframe, to the outside, pitch period storage section 102 and adaptive excitation codebook 103.

The CELP speech encoding apparatus including adaptive excitation vector quantization apparatus 100 transmits speech encoded information including the pitch period index IDX generated in evaluation measure comparison section 108, to the CELP decoding apparatus including the adaptive speech vector dequantization apparatus according to the present embodiment. The CELP decoding apparatus acquires the pitch period index IDX by decoding the received speech encoded information and then inputs the pitch period index IDX in the adaptive excitation vector dequantization apparatus according to the present embodiment. Further, like the speech encoding processing in the CELP speech encoding apparatus, speech decoding processing in the CELP decoding apparatus is also performed in subframe units, and the CELP decoding apparatus inputs subframe indices in the adaptive excitation vector dequantization apparatus according to the present embodiment.

Figure 3:
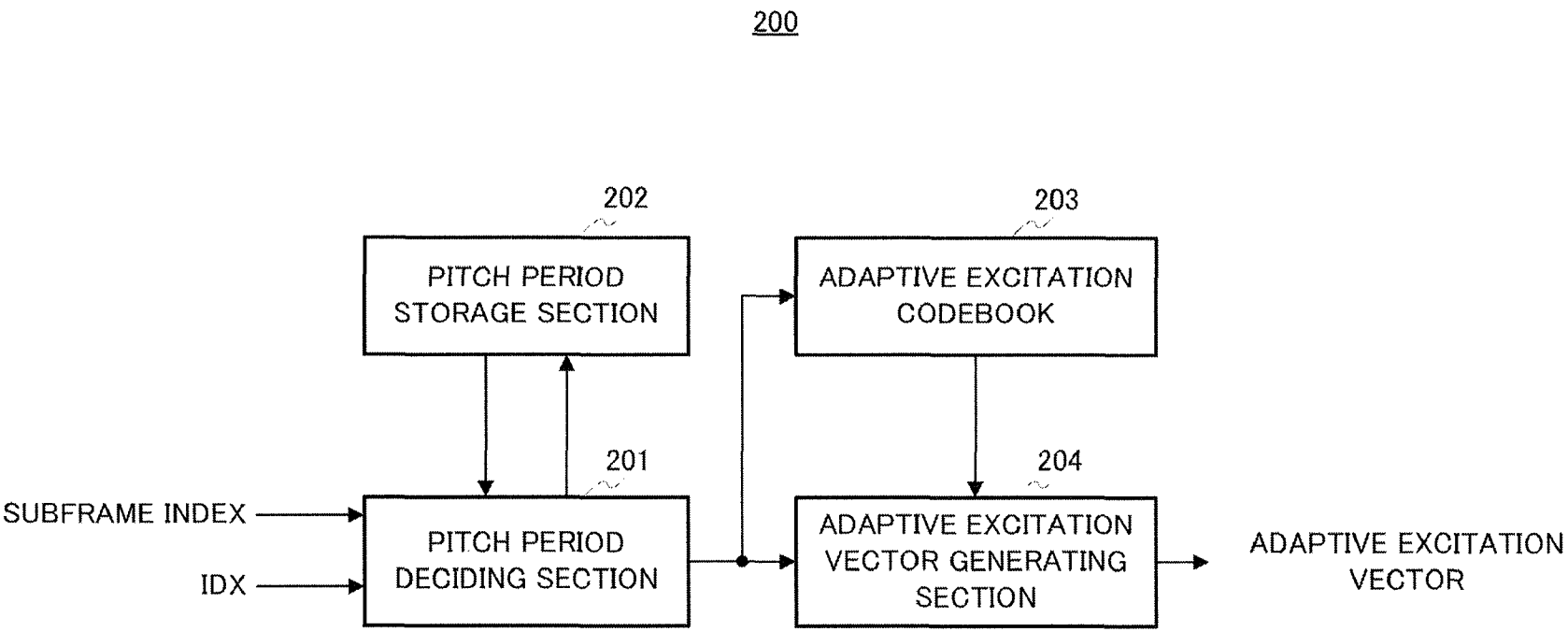
FIG. 3 is a block diagram showing main components of an adaptive excitation vector dequantization apparatus according to Embodiment 1 of the present invention.

FIG. 3 is a block diagram showing main components of adaptive excitation vector de quantization apparatus 200 according to the present embodiment.

In FIG. 3, adaptive excitation vector dequantization apparatus 200 is provided with pitch period deciding section 201, pitch period storage section 202, adaptive excitation codebook 203 and adaptive excitation vector generating section 204, and receives as input the subframe indices generated in the CELP speech decoding apparatus and pitch period index IDX.

If a subframe index that is received as input on a per subframe basis indicates the first subframe, pitch period deciding section 201 outputs the pitch period T_int' associated with the input pitch period index IDX, to pitch period storage section 202, adaptive excitation codebook 203 and adaptive excitation vector generating section 204. Further, if an input subframe index that is received as input on a per subframe basis indicates the second subframe, pitch period deciding section 201 adds the pitch period difference associated with the input pitch period index and the pitch period T_int' of the first subframe stored in pitch period storage section 202, and outputs the resulting pitch period T_int' to adaptive excitation codebook 203 and adaptive excitation vector generating section 204 as the pitch period in the second subframe.

Pitch period storage section 202 stores the pitch period T_int' of the first subframe, which is received as input from pitch period deciding section 201, and pitch period deciding section 201 reads the stored pitch period T_int' of the first subframe in the processing of the second subframe.

Adaptive excitation codebook 203 has a built-in buffer storing the same excitations as the excitations provided in adaptive excitation codebook 103 of adaptive excitation vector quantization apparatus 100, and updates the excitations using the adaptive excitation vector having the pitch period T_int' received as input from pitch period deciding section 201 every time adaptive excitation decoding processing is finished on a per subframe basis.

If an input subframe index that is received as input on a per subframe basis indicates the first subframe, adaptive excitation vector generating section 204 cuts out, from adaptive excitation codebook 203, the subframe length m of the adaptive excitation vector P'(T_int') having the pitch period T_int' received as input from pitch period deciding section 201, and outputs the result as an adaptive excitation vector. The adaptive excitation vector P'(T_int') generated in adaptive excitation vector generating section 204 is represented by following equation 9.

(Equation 9)

$$P'(\mathrm{T_int}') = P'\begin{bmatrix} exc(e-\mathrm{T_int}') \\ exc(e-\mathrm{T_int}'+1) \\ \vdots \\ exc(\mathrm{e_T_int}'+m-1) \end{bmatrix} \quad [9]$$

Thus, according to the present embodiment, in CELP speech encoding for performing linear prediction encoding in subframe units, when adaptive excitation vector quantization is performed in subframe units using the greater amount of information in the first subframe than in the second subframe, the adaptive excitation vector quantization of the first subframe is performed by forming an impulse response matrix of longer rows and columns than the subframe length with linear prediction coefficients per subframe and by cutting out a longer adaptive excitation vector than the subframe length from the adaptive excitation codebook. By this means, it is possible to alleviate the imbalance in the accuracy of quantization in adaptive excitation vector quantization between subframes and improve the overall accuracy of speech encoding.

Further, although an example case has been described above with the present embodiment where the value of r is set in advance to hold the relationship of $m<r\leqq n$, the present invention is not limited to this, and it is equally possible to adaptively change the value of r based on the amount of information involved in adaptive excitation vector quantization per subframe. For example, by setting the value of r to be higher when the amount of information involved in the adaptive excitation vector quantization of the second subframe decreases, it is possible to increase the range to cover the second subframe in the adaptive excitation vector quantization of the first subframe, and effectively alleviate the imbalance in the accuracy of adaptive excitation vector quantization between these subframes.

Further, although an example case has been described with the present embodiment where 256 patterns of pitch period candidates from "32" to "287" are used, the present invention is not limited to this, and it is equally possible to set a different range of pitch period candidates.

Further, although a case has been assumed and explained above with the present embodiment where a CELP speech encoding apparatus including adaptive excitation vector quantization apparatus 100 divides one frame into two subframes and performs a linear prediction analysis of each subframe, the present invention is not limited to this, and a CELP speech encoding apparatus can divide one frame into three subframes or more and perform a linear prediction analysis of each subframe.

Further, although an example case has been described above with the present embodiment where adaptive excitation codebook 103 updates excitations based on a pitch period index IDX fed back from evaluation measure comparison section 108, the present invention is not limited to this, and it is equally possible to update excitations using excitation vectors generated from adaptive excitation vectors and fixed excitation vectors in CELP speech encoding.

Further, although an example case has been described above with the present embodiment where a linear prediction residual vector is received as input and the pitch period of the linear prediction residual vector is searched for with an adaptive excitation codebook, the present invention is not limited to this, and it is equally possible to receive as input a speech signal as is and directly search for the pitch period of the speech signal.

(Embodiment 2)

Figure 4:
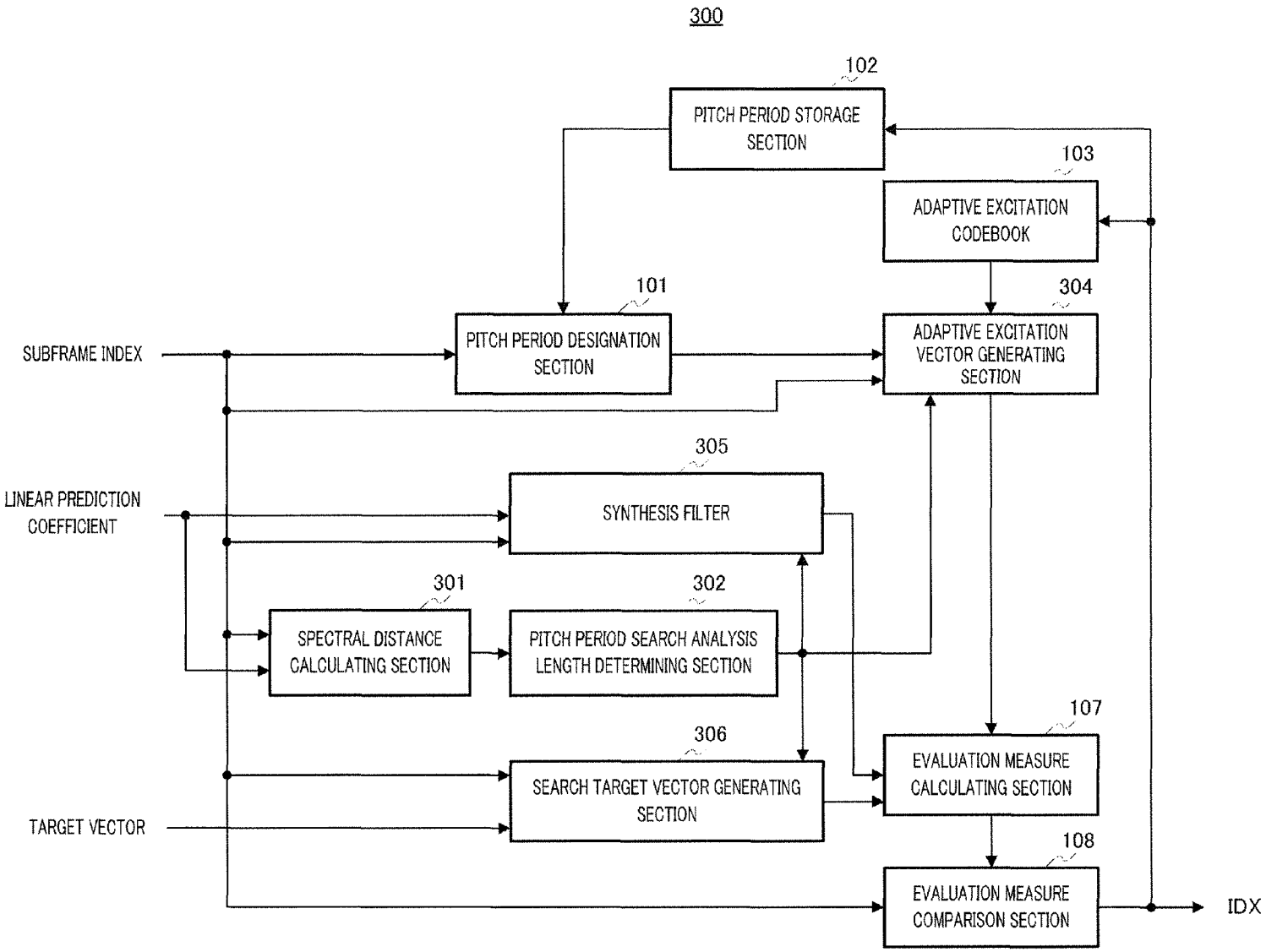
FIG. 4 is a block diagram showing main components of an adaptive excitation vector quantization apparatus according to Embodiment 2 of the present invention.

FIG. 4 is a block diagram showing main components of adaptive excitation vector quantization apparatus 300 according to Embodiment 2 of the present invention.

Further, adaptive excitation vector quantization apparatus 300 has the same basic configuration as adaptive excitation vector quantization apparatus 100 shown in Embodiment 1, and therefore the same components will be assigned the same reference numerals and their explanations will be omitted.

Adaptive excitation vector quantization apparatus 300 differs from adaptive excitation vector quantization apparatus 100 in adding spectral distance calculating section 301 and pitch period search analysis length determining section 302. Adaptive excitation vector generating section 304, synthesis filter 305 and search target vector generating section 306 of adaptive excitation vector quantization apparatus 300 differ from adaptive excitation vector generating section 104, synthesis filter 105 and search target vector generating section 106 of adaptive excitation vector quantization apparatus 100, in part of processing, and are therefore assigned different reference numerals.

Spectral distance calculating section 301 converts the linear prediction coefficient of the first subframe received as input and the linear prediction coefficient of a second subframe received as input into spectrums, calculates the distance between the first subframe spectrum and the second subframe spectrum, and outputs the result to pitch period search analysis length determining section 302.

Pitch period search analysis length determining section 302 determines the pitch period search analysis length r based on the spectral distance between those subframes received as input from spectral distance calculating section 301, and outputs the result to adaptive excitation vector generating section 304, synthesis filter 305 and search target vector generating section 306.

Along spectral distance between subframes means greater fluctuation of phonemes between these subframes, and there is a high possibility that the fluctuation of pitch period between subframes is greater according to the fluctuation of phonemes. Therefore, in the "delta lag" method utilizing the regularity of the pitch period in time, when the spectral distance between subframes is long and the fluctuation of pitch period is greater according to the long spectral distance, there is a high possibility that the "delta lag" pitch period search range cannot sufficiently cover the fluctuation of pitch period between subframes. Therefore, by adaptively changing the overlapped length of the analysis length in the pitch period search in the first subframe to the second subframe side according to the level of the regularity of the pitch period in time, it is possible to improve the accuracy of quantization. In this case, the present embodiment improves the accuracy of quantization by making the pitch period search analysis length r in the first subframe longer with further consideration of the second subframe in the pitch period search in the first subframe.

That is, when the difference between the pitch period in the first subframe and the pitch period in the second subframe is large (i.e. the pitch periods are relatively irregular), the longer analysis length is overlapped to the second subframe side at the time of the pitch period search in the first subframe. By this means, it is possible to select a pitch period with further consideration of the second subframe as the pitch period in the first subframe, so that the delta lag efficiently works in the second subframe, thereby improving the inefficiency of delta lag due to the irregularity of the pitch period in time. On the other hand, when the difference between the pitch period in the first subframe and the pitch period in the second subframe is small (i.e. the pitch periods are relatively regular), by overlapping the analysis length in the pitch period search in the first subframe to the second subframe side by a required length, without overlapping the analysis length excessively, it is possible to adequately correct the imbalance in the accuracy of pitch period search in the time domain.

To be more specific, pitch period search analysis length determining section 302 sets the value of r' to meet the condition of $m<r'\leqq n$ as the pitch period search analysis length r if the spectral distance between subframes is equal to or less than a predetermined threshold, while setting the value of r" to meet the conditions of $m<r'\leqq n$ and $r'<r''$ as the pitch period analysis search length r if the spectral distance between subframes is greater than the predetermined threshold.

Adaptive excitation vector generating section 304, synthesis filter 305 and search target vector generating section 306 differ from adaptive excitation vector generating section 104, synthesis filter 105 and search target vector generating section 106 of adaptive excitation vector quantization apparatus 100 only in using the pitch period search analysis length r received as input from pitch period search analysis length determining section 302, instead of the pitch period search analysis length r set in advance, and therefore detailed explanation will be omitted.

Thus, according to the present embodiment, an adaptive excitation vector quantization apparatus determines the pitch period search analysis length r according to the spectral distance between subframes, so that, when the fluctuation of pitch period between subframes is greater, it is possible to set the pitch period search analysis length r to be longer, thereby further alleviating the imbalance in the accuracy of quantization in adaptive excitation vector quantization between these subframes and further improving the overall accuracy of speech encoding.

Further, although an example case has been described above with the present embodiment where spectral distance calculating section 301 calculates spectrums from linear prediction coefficients and where pitch period search analysis length determining section 302 determines the pitch period search analysis length r according to the spectral distance between subframes, the present invention is not limited to this, and pitch period search analysis length determining section 302 can determine the pitch period search analysis length r according to the cepstrum distance, the distance between α parameters, the distance in the LSP region, and so on.

Further, although an example case has been described above with the present embodiment where pitch period search analysis length determining section 302 uses the spectral distance between subframes as a parameter to predict the degree of fluctuation of pitch period between subframes, the present invention is not limited to this, and, as a parameter to predict the degree of fluctuation of pitch period between subframes, that is, as a parameter to predict the regularity of the pitch period in time, it is possible to use the power difference between subframes of an input speech signal or the difference of pitch periods between subframes. In this case, when the fluctuation of phonemes between subframes is greater, the power difference between these subframes or the difference of pitch periods between these subframes in a previous frame is larger, and, consequently, the pitch period search analysis length r is set longer.

The operations of an adaptive excitation vector quantization apparatus will be explained below in a case where, as a parameter to predict the degree of fluctuation of pitch period between subframes, the power difference between subframes of an input speech signal or the difference of pitch periods between subframes in the previous frame is used.

Figure 5:
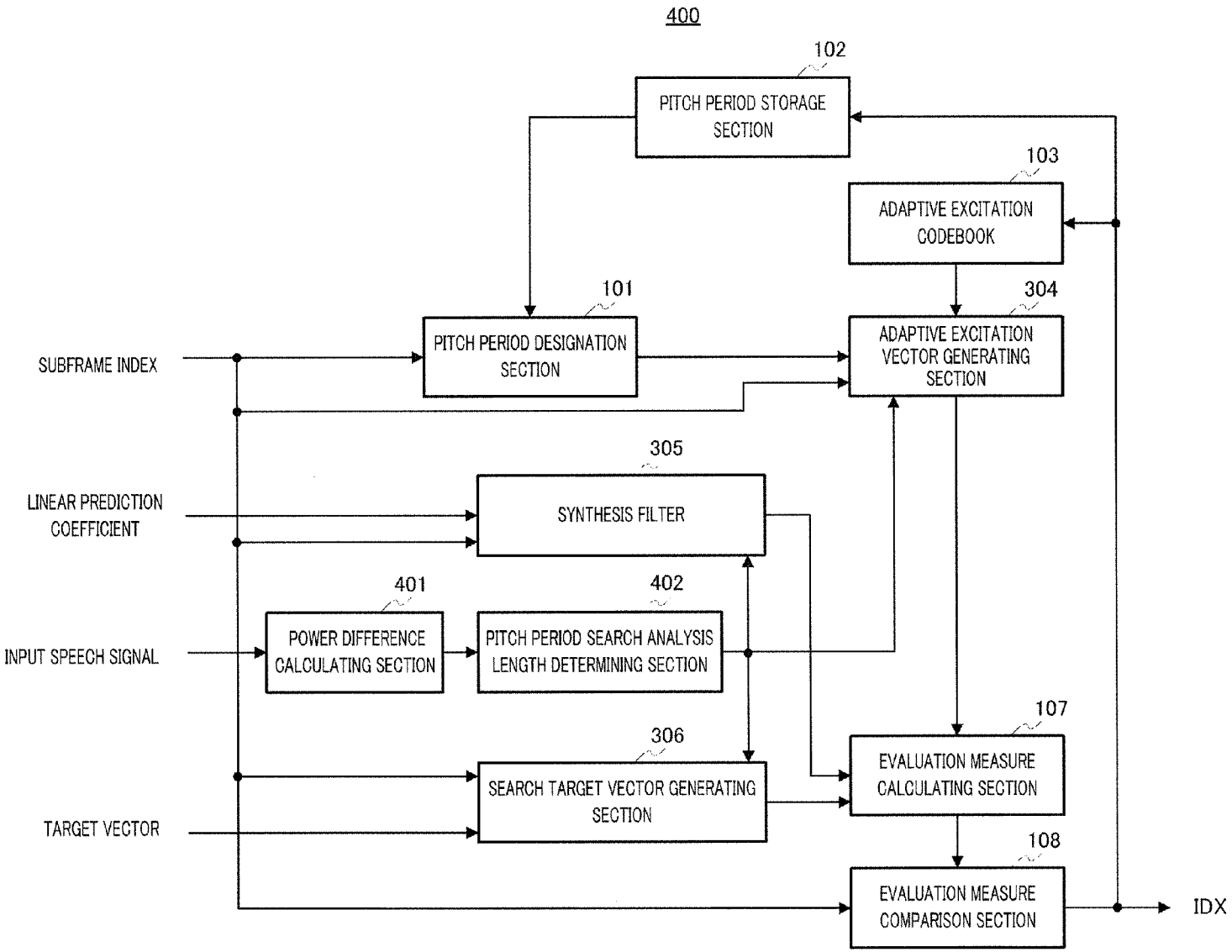
FIG. 5 is a block diagram showing main components of an adaptive excitation vector quantization apparatus according to Embodiment 2 of the present invention.

If the power difference between subframes of an input speech signal is used as a parameter to predict the degree of fluctuation of pitch period between subframes, power difference calculating section 401 of adaptive excitation vector quantization apparatus 400 shown in FIG. 5 calculates the power difference between the first subframe and second subframe of the input speech signal, Pow_dist, according to following equation 10.

(Equation 10)

$$\text{Pow_dist}\left|\sum_{0}^{i=m-1}(sp(m+i)^2-sp(i)^2)\right| \quad [10]$$

Here, sp is the input speech represented by sp(0), sp(1), . . . , sp(n−1). Further, sp(0) is the input speech sample corresponding to the current time, and the input speech associated with the first subframe is represented by sp(0), sp(1), . . . , sp(m−1), while the input speech associated with the second subframe is represented by sp(m), sp(m+1), . . . , sp(n−1).

Power difference calculating section 401 may calculate the power difference from sample input speech of a subframe length according to above equation 10 or may calculate the power difference from input speech of a length m2 where m2>m, including the range of past input speech, according to following equation 11.

(Equation 11)

$$\text{Pow_dist}\left|\sum_{0}^{i=m2-1}(sp(i-m2+n)^2-sp(i-m2+m)^2)\right| \quad [11]$$

Pitch period search analysis length determining section 402 sets the value of the pitch period search analysis length r to r' to meet the condition of $m<r'\leqq n$, when the power difference between subframes is equal to or less than a predetermined threshold. Further, if the power difference between subframes is greater than the predetermined threshold, pitch period search analysis length determining section 402 sets the value of the pitch period search analysis length r to r", to meet the conditions of m<r"≦n and r'<r".

Figure 6:
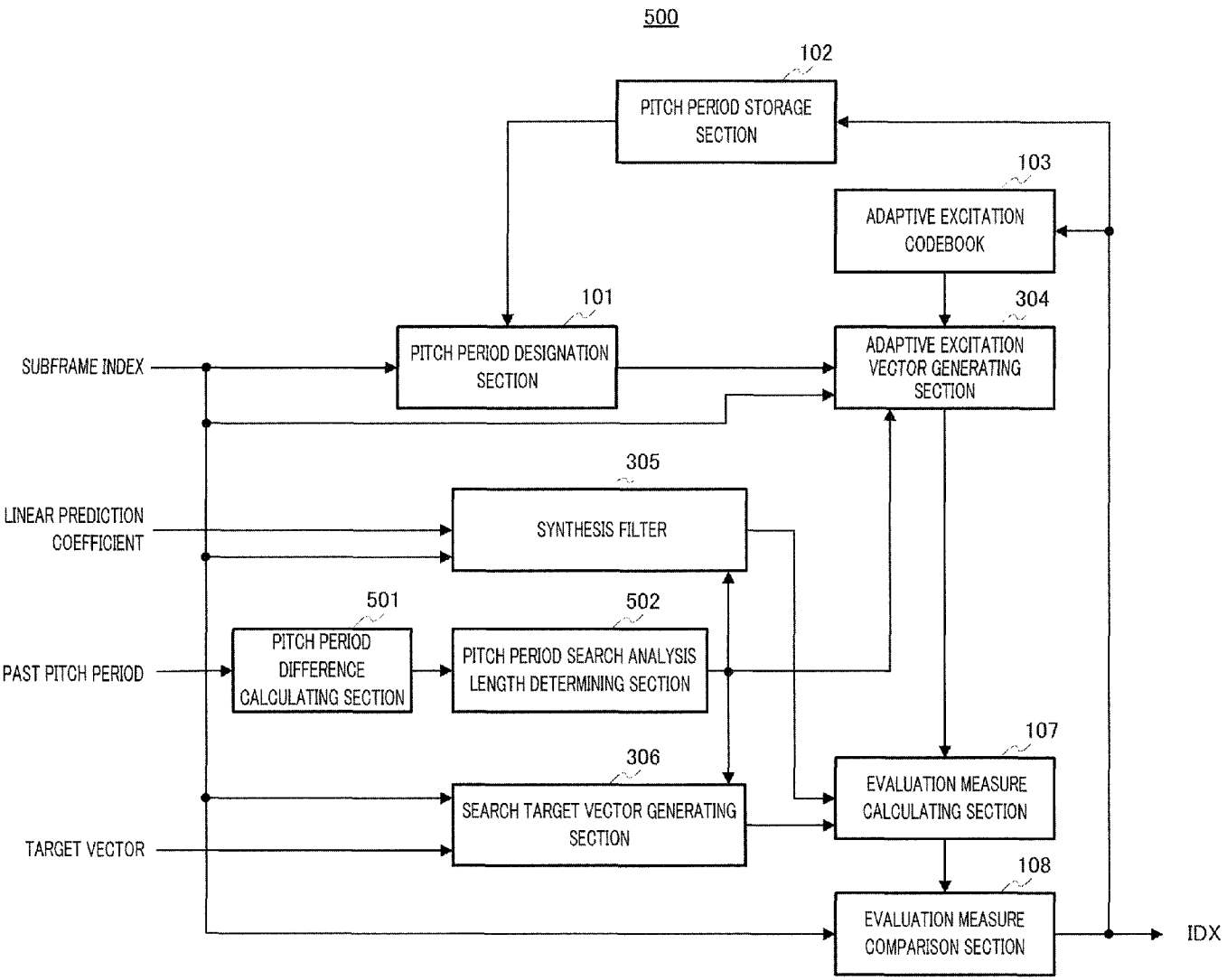
FIG. 6 is a block diagram showing main components of an adaptive excitation vector quantization apparatus according to Embodiment 2 of the present invention.

On the other hand, if the difference of pitch periods between subframes in the previous frame is used as a parameter to predict the degree of fluctuation of pitch period between these subframes, pitch period difference calculating section 501 of adaptive excitation vector quantization apparatus 500 shown in FIG. 6 calculates the difference of pitch periods between the first subframe and the second subframe in the previous frame, Pit_dist, according to following equation 12.

[12]

$$\text{Pit_dist}=|T_\text{pre2}-T_\text{pre1}| \quad \text{(Equation 12)}$$

Here, T_pre1 is the pitch period in the first subframe of the previous frame, and T_pre2 is the pitch period in the second subframe of the previous frame.

Pitch period search analysis length determining section 502 sets the value of the pitch period search analysis length r to r', to meet the condition of m<r'≦n, if the difference of pitch periods between subframes in the previous frame, Pit_dist, is equal to or less than a predetermined threshold. Further, if the difference of pitch periods between subframes in the previous frame, Pit_dist, is greater than a predetermined threshold, pitch period search analysis length determining section 502 sets the value of the pitch period search analysis length r to r", to meet the conditions of m<r"≦n and r'<r".

Further, pitch period search analysis length determining section 502 may use only one of the pitch period T_pre1 of the first subframe or the pitch period T_pre2 of the second subframe in a past frame, as a parameter to predict the degree of fluctuation of pitch period between these subframes.

There is a statistical tendency that the pitch period in the current frame is likely to fluctuate significantly compared to the pitch period in the previous frame when the value of the pitch period in a past frame is higher, while the fluctuation of the pitch period in the current frame is likely to be insignificant compared to the pitch period in the previous frame when the value of the pitch period in a past frame is lower. Therefore, in the "delta lag" method utilizing the regularity of the pitch period in time, when the pitch period in a past frame is high and the fluctuation of pitch period is greater in accordance with the high pitch period in the past frame, there is a high possibility that the "delta lag" pitch period search range cannot sufficiently cover the fluctuation of pitch period between subframes. Therefore, in this case, by setting the pitch period search analysis length r in the first subframe longer with further consideration of the second subframe in the pitch period search in the first subframe, it is possible to improve the accuracy of quantization. For example, pitch period search analysis length determining section 502 sets the value of the pitch period search analysis length r to r', to meet the condition of m<r'≦n if the value of the pitch period in the second subframe of a past frame, T_pre2, is equal to or lower than a predetermined threshold, while setting the value of the pitch period search analysis length r to r", to meet the conditions of m<r"≦n and r'<r", if the value of the pitch period in the second subframe of the past frame, T_pre2, is higher than the predetermined threshold.

Further, although an example case has been described above with the present embodiment where a parameter to predict the degree of fluctuation of pitch period between subframes is compared to one threshold and the pitch period search analysis length r is determined based on the comparison result, the present invention is not limited to this, and it is equally possible to compare a parameter to predict the degree of fluctuation of pitch period between subframes to a plurality of thresholds and set the pitch period search analysis length r shorter when the parameter to predict the degree of fluctuation of pitch period between subframes is higher.

Embodiments of the present invention have been described above.

The adaptive excitation vector quantization apparatus according to the present invention can be mounted on a communication terminal apparatus in a mobile communication system that transmits speech, so that it is possible to provide a communication terminal apparatus having the same operational effect as above.

Although a case has been described with the above embodiments as an example where the present invention is implemented with hardware, the present invention can be implemented with software. For example, by describing the adaptive excitation vector quantization method according to the present invention in a programming language, storing this program in a memory and making the information processing section execute this program, it is possible to implement the same function as the adaptive excitation vector quantization apparatus and adaptive excitation vector dequantization apparatus according to the present invention.

Furthermore, each function block employed in the description of each of the aforementioned embodiments may typically be implemented as an LSI constituted by an integrated circuit. These may be individual chips or partially or totally contained on a single chip.

"LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells in an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The disclosures of Japanese Patent Application No. 2006-338343, filed on Dec. 15, 2006, and Japanese Patent Application No. 2007-137031, filed on May 23, 2007, including the specifications, drawings and abstracts, are included herein by reference in their entireties.

Industrial Applicability

The adaptive excitation vector quantization apparatus and adaptive excitation vector quantization method according to the present invention are applicable to speech encoding, speech decoding and so on.

The invention claimed is:

1. An adaptive excitation vector quantization apparatus that receives, as an input, linear prediction residual vectors of a length m and linear prediction coefficients generated by dividing a frame of a length n into a plurality of subframes of the length m and performing a linear prediction analysis where the length n and the length m are integers, and that performs adaptive excitation vector quantization per subframe using more bits in a first subframe than in a second subframe, the apparatus comprising:

an adaptive excitation vector generator including at least one of at least one processor and at least one circuit that cuts out an adaptive excitation vector of an adaptively changed length r from an adaptive excitation codebook, the length r being greater than the length m and at most equal to the length n;

a target vector generator including at least one of the at least one processor and the at least one circuit that generates a target vector of the length r from the linear prediction residual vectors of the plurality of subframes;

a synthesis filter including at least one of the at least one processor and the at least one circuit that generates a r×r impulse response matrix using the linear prediction coefficients of the plurality of subframes;

an evaluation measure calculator including at least one of the at least one processor and the at least one circuit that calculates evaluation measures of adaptive excitation vector quantization with respect to a plurality of pitch period candidates, using the adaptive excitation vector of the length r, the target vector of the length r and the r×r impulse response matrix; and an evaluation measure comparator including at least one of the at least one processor and the at least one circuit that compares the evaluation measures with respect to the plurality of pitch period candidates and finds a pitch period of a highest evaluation measure as a result of the adaptive excitation vector quantization of the first subframe, wherein, when a difference is larger between a first number of bits involved in the adaptive excitation vector quantization of the first subframe and a second number of bits involved in the adaptive excitation vector quantization of the second subframe, the length r is set longer.

2. The adaptive excitation vector quantization apparatus according to claim 1, further comprising:

a distance calculator including at least one of the at least one processor and the at least one circuit that converts the linear prediction coefficients of the plurality of subframes into a plurality of spectrums and calculates distances between the plurality of spectrums; and a setter including at least one of the at least one processor and the at least one circuit that sets the length r longer when the distances between the plurality of spectrums are longer in spectral distance.

3. The adaptive excitation vector quantization apparatus according to claim 1, further comprising:

a power difference calculator including at least one of the at least one processor and the at least one circuit that calculates a power difference between the plurality of subframes; and a setter including at least one of the at least one processor and the at least one circuit that sets the length r longer when the power difference between the plurality of spectrums is greater.

4. The adaptive excitation vector quantization apparatus according to claim 1, further comprising:

a setter that sets the length r longer when the pitch periods of the plurality of spectrums in a past frame are longer.

5. The adaptive excitation vector quantization apparatus according to claim 1, further comprising:

a difference calculator including at least one of the at least one processor and the at least one circuit that calculates a difference of the pitch periods between the plurality of subframes in a past frame; and a setter including at least one of the at least one processor and the at least one circuit that sets the length r longer when the difference of the pitch periods between the plurality of subframes in the past frame are larger.

6. A CELP speech encoding apparatus comprising the adaptive excitation vector quantization apparatus according to claim 1.

7. An adaptive excitation vector quantization method that receives, as an input, linear prediction residual vectors of a length m and linear prediction coefficients generated by dividing a frame of a length n into a plurality of subframes of the length m and performing a linear prediction analysis where the length n and the length m are integers, and that performs adaptive excitation vector quantization per subframe using more bits in a first subframe than in a second subframe, the method comprising:

cutting out, with at least one of at least one processor and at least one circuit, an adaptive excitation vector of an adaptively changed length r from an adaptive excitation codebook, the length r being greater than the length m and at most equal to the length n;

generating, with at least one of the at least one processor and the at least one circuit, a target vector of the length r from the linear prediction residual vectors of the plurality of subframes;

generating, with at least one of the at least one processor and the at least one circuit, a r×r impulse response matrix using the linear prediction coefficients of the plurality of subframes;

calculating, with at least one of the at least one processor and the at least one circuit, evaluation measures of adaptive excitation vector quantization with respect to a plurality of pitch period candidates, using the adaptive excitation vector of the length r, the target vector of the length r and the r×r impulse response matrix;

comparing, with at least one of the at least one processor and the at least one circuit, the evaluation measures with respect to the plurality of pitch period candidates and finding the pitch period of a highest evaluation measure as a result of the adaptive excitation vector quantization of the first subframe; and when a difference is larger between a first number of bits involved in the adaptive excitation vector quantization of the first subframe and a second number of bits involved in the adaptive excitation vector quantization of the second subframe, setting the length r longer.

8. The adaptive excitation vector quantization method according to claim 7, further comprising:

converting the linear prediction coefficients of the plurality of subframes into a plurality of spectrums and calculating distances between the plurality of spectrums; and setting the length r longer when the distances between the plurality of spectrums are longer in spectral distance.

9. The adaptive excitation vector quantization method according to claim 7, further comprising:

calculating a power difference between the plurality of subframes; and setting the length r longer when the power difference between the plurality of spectrums is greater.

10. The adaptive excitation vector quantization method according to claim 7, further comprising:

setting the length r longer when the pitch periods of the plurality of spectrums in a past frame are longer.

11. The adaptive excitation vector quantization method according to claim 7, further comprising:

calculating a difference of the pitch periods between the plurality of subframes in a past frame; and setting the length r longer when the difference of the pitch periods between the plurality of subframes in the past frame are larger.

* * * * *